United States Patent [19]

Vasquez

[11] 4,199,822

[45] Apr. 29, 1980

[54] BLOUSE

[75] Inventor: Orsolina L. Vasquez, Williamsburg, Mich.

[73] Assignee: Free Form, Inc., Elk Rapids, Mich.

[21] Appl. No.: 943,786

[22] Filed: Sep. 20, 1978

[51] Int. Cl.[2] ..... A41D 1/18

[52] U.S. Cl. ..... 2/106

[58] Field of Search ..... 2/106, 105, 74, 67, 2/91, 207, 69, 49

[56] References Cited

U.S. PATENT DOCUMENTS

| | | | |
|---|---|---|---|
| 3,105,970 | 10/1963 | Herzberg | 2/91 |
| 3,360,802 | 1/1968 | Kasamatsu | 2/91 |
| 3,704,469 | 12/1972 | Levy | 2/67 |
| 3,877,078 | 4/1975 | Tepper | 2/74 |

*Primary Examiner*—Werner H. Schroeder
*Assistant Examiner*—Doris L. Troutman
*Attorney, Agent, or Firm*—Gifford, VanOphem, Sheridan & Sprinkle

[57] ABSTRACT

A unique female garment is provided which comprises a first and a second garment member. Each garment member is planar and substantially triangular in shape and is fashioned from stretchable material which is relatively non-stretchable along a front edge. At least one corner of one garment member is connected to one corner of the other garment member by a control knot which regulates the size of the garment and the position of the garment on the body. The control knot is positioned adjacent the back and shoulders of the user and the remaining portion of the garment is wrapped around the body whereupon the remaining corners of the garment members are tied together to thereby secure the garment in place. The garment can be wrapped around the body of the user in any of a plurality of fashions, each fashion having a different appearance.

9 Claims, 15 Drawing Figures

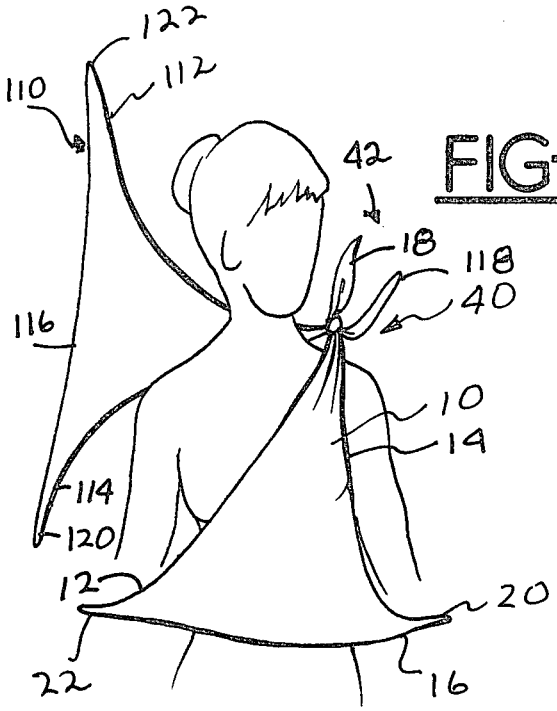
FIG-4A
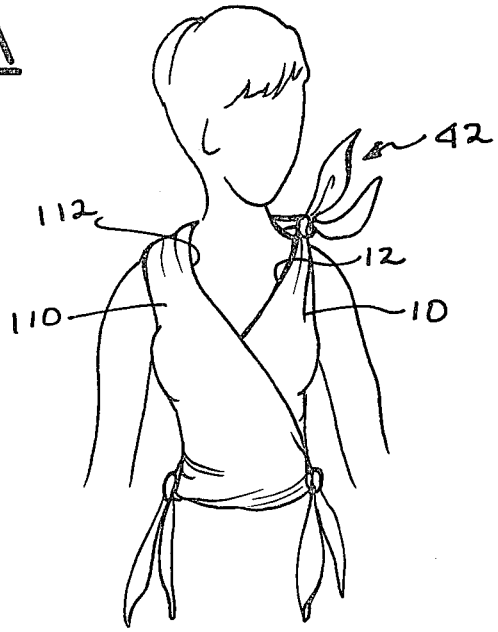
FIG-4B
FIG-9A
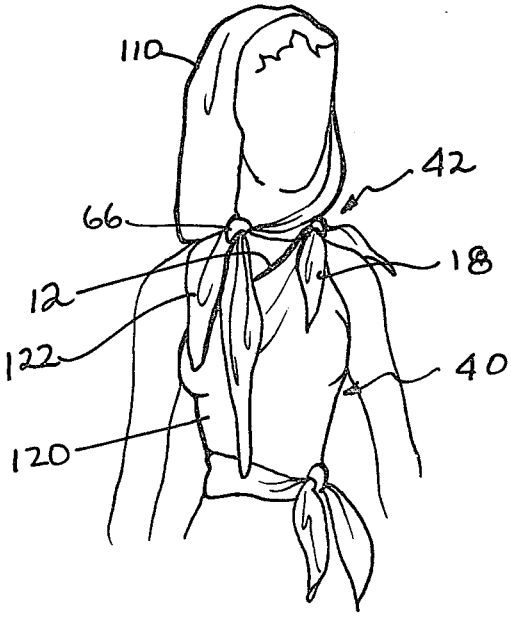
FIG-9B
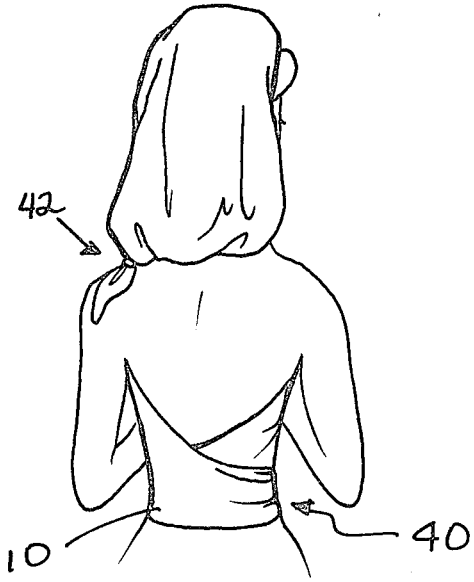

BLOUSE

BACKGROUND OF THE INVENTION

1. Field of the Invention

The present invention relates generally to wearing apparel and, more particularly, to an exterior female garment adapted to be worn about the upper portion of the torso.

2. Description of the Prior Art

There are a plurality of previously known garments, such as blouses, sweaters and the like which are worn by females around their upper body portion, i.e. about their torso. The previously known garments, however, typically can be worn in only a single fashion so that when the wearer wishes to change the appearance of her clothes, she must change into a different garment. Clothing, however, is quite costly so that the maintenance of a large wardrobe is prohibitively expensive for most persons.

Moreover, in order to construct these previously known garments, the required material is conventionally cut according to a complex pattern from a bolt of cloth or other material. These sewing patterns are not only in themselves expensive due to their complexity, but also result in wasted material due to inevitable spaces between the sewing pattern. Moreover, it is a time consuming, difficult and, therefore, expensive process to sew the garment pieces together once cut from the fabric.

SUMMARY OF THE PRESENT INVENTION

The present invention overcomes the above-mentioned disadvantages of the previously known female garments by providing a female garment which is not only simple and inexpensive in construction but which also can be worn by the user in a plurality of different fashions or styles.

In brief the garment according to the present invention comprises a first and second garment member which are substantially identical to each other. Each garment member is planar, substantially triangular in shape and is preferably constructed from a stretchable fabric with the front edge of the garment extending in the non-stretchable direction of the fabric.

At least one corner of one garment member is releasably tied to one corner of the other garment member to form a control knot. The control knot is so called because it controls the size and position of the garment. The resulting garment is wrapped around the body of the user in the desired fashion. The remaining corners of the garment members are then tied together to secure the garment in place. In a manner which will become hereinafter more apparent, the garment can be wrapped around the body of the user in any of a plurality of different fashions or styles.

In one preferred form of the invention, each garment member further comprises a first and second triangular, planar sheet of fabric wherein the sheets are secured in registration to each other. The two sheets for each garment member are in addition, preferably different colored so that not only the fashion of the garment, but also its color, can be varied. Each sheet is constructed of a stretchable material with the front edge of the garment extending in the non-stretching direction of the material for a purpose to be described later.

As also will become hereinafter more apparent, the garment according to the present invention can be adapted to fit women of varying sizes within a given range by simplying varying the tie points at the control knot to thereby eliminate slack in the garment.

BRIEF DESCRIPTION OF THE DRAWINGS

A better understanding of the present invention will be had upon reference to the following detailed description when read in conjunction with the accompanying drawing, wherein like reference characters refer to like parts throughout the several views, and in which:

FIGS. 4A and 4B illustrate one preferred arrangement of the garment members on a wearer of the garment;

FIGS. 9A and 9B illustrate yet another manner of wearing the garment of the present invention.

DETAILED DESCRIPTION OF THE PRESENT INVENTION

Figure 1:
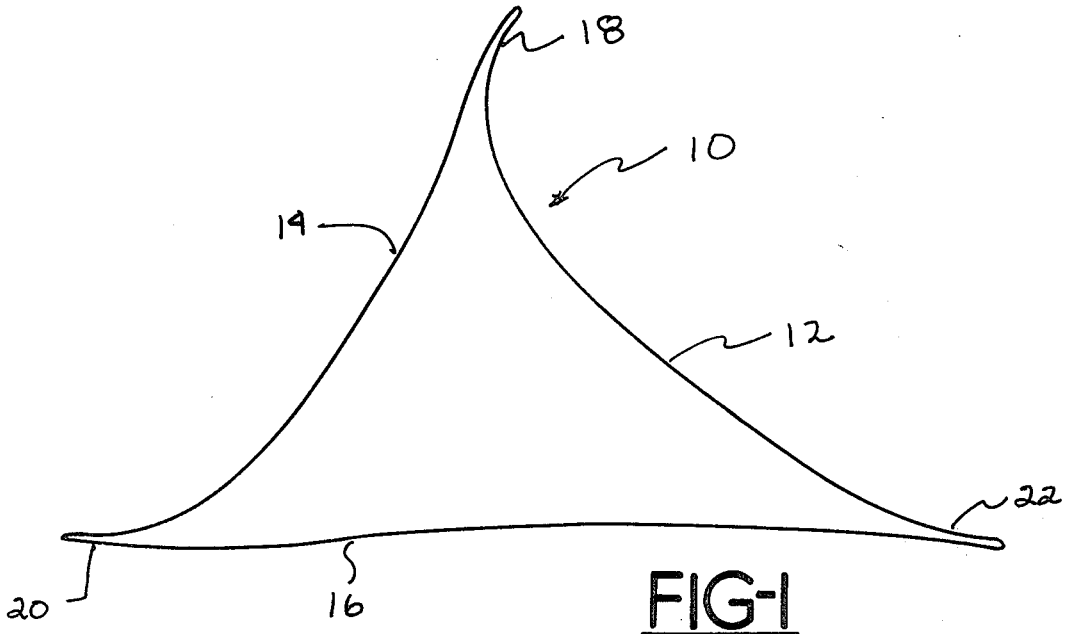
FIG. 1 is a plan view illustrating a garment member of the present invention.

With reference first to FIG. 1, a garment member 10 according to the present invention is thereshown as being substantially triangular in shape having a front edge 12, a back edge 14 and a waist edge 16. Corner portions 18, 20 and 22 connect the front edge 12 and the back edge 14, the back edge 14 and the waist edge 16, and the waist edge 16 and the front edge 12, respectively.

Figure 2:
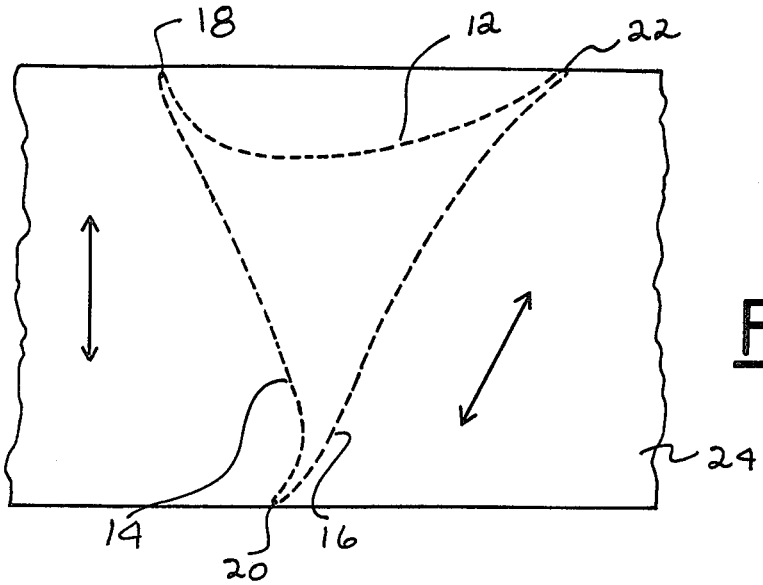
FIG. 2 is a plan view illustrating the preferred manner of cutting a garment member from a piece of stretchable material.

The edges 12, 14 and 16 are preferably formed concavely as can best be seen in FIG. 1. As best seen in FIG. 2, the garment member 10 is preferably cut from a sheet of stretchable material 24. Such material is conventionally formed so that it stretches in one direction but is relatively non-stretchable in a direction substantially 90° with respect to the stretching direction. In FIG. 2, the substantially triangular garment member 10 is laid out on the material such that the waist edge 16 and the back edge 14 extend substantially in the direction of the stretch of the material 24 as shown by the arrows in FIG. 2 while the front edge 12 extends in the non-stretching direction of the fabric, i.e. at substantially 90° with respect to the edges 14 and 16.

The garment member 10 is substantially an equilateral triangle and, therefore, the length of the edges 12, 14 and 16 is substantially twice as long as the distance from one of the corners 18, 20 or 22 to the opposite edge 16, 12 or 14, respectively. For example, in a garment member 10 intended to fit medium size woman, i.e. approximately size 36, the edges 12, 14 and 16 would preferably be about 63 inches and the distance from the corners 18, 20 and 22 to the edges 12, 14 and 16 would be about 33 inches.

Figure 3:
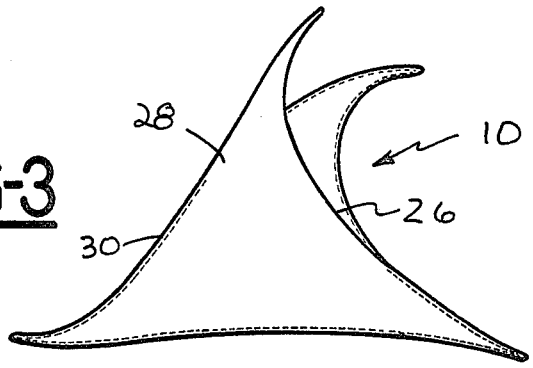
FIG. 3 is a view illustrating one preferred manner of making a garment member from two different pieces of cloth.

With reference now to FIG. 3, the garment member 10 is thereshown as comprising a first substantially triangular sheet 26 and a second substantially triangular sheet 28. The triangular sheets 26 and 28 are preferably different colored and are secured in registry to each other by conventional means, such as by stitching 30 along the edges 12, 14 and 16 of the garment member 10.

As will become more apparent as the description proceeds, the garment of the present invention will generally comprise two or more of the garment members 10. The additional garment members are substantially identical to the garment member 10 which has been described but will be indicated by the reference numeral 110. The various parts of the additional garment member 110 will be indicated by the same reference numerals utilized to indicate corresponding parts of garment member 10 with 100 being added to each so that it will be clear which part of which garment member is being discussed.

In all of the arrangements which will be described, it should be noted that a control knot 42 is utilized to tie the two garment members 10 and 110 together. The control knot 42 is positioned across a shoulder or around the neck of the user and positioning the control knot 42 in this manner is the first step in positioning the garment 40 in place on the user.

Further, by adjusting the knot 42 at different lengths along the corners which are tied together, the size of the garment-within a predetermined range-can be adjusted. Also, the different position of the control knot 42 adjusts the position of the garment 40 on the body of the user.

Also in each arrangement, the non-stretchable front edge 12–112 of the garment member 10–110 will be positioned along the upper portion of the breasts of the user or diagonally across one or both of the breasts of the user in a manner which insures that the breasts will stay beneath the garment member. This is, of course, important if the garment member is to be worn without underclothing.

If the stretchable edges 14 or 16 were positioned as described above or if the garment member were cut from the fabric in such a way that it was substantially equally stretchable along all of its edges, it would be very difficult to make the garment conform to the body of the wearer and to insure that the breasts of the user will be properly covered.

Referring now to FIGS. 4A and 4B, the manner of wearing the two garment members 10 and 110 to form one preferred arrangement of the garment 40 of the present invention is illustrated. First, the corner 18 of the garment member 10 and the corner 118 of the garment member 110 are tied together to form a control knot 42 which is placed on the left shoulder of the wearer of the garment 40. The front edge 12 of the first garment member 10 is then brought diagonally across the front of the wearer and the corner 22 is wrapped around the front of the wearer. The corner 20 is wrapped around the back of the wearer and is tied at the user's right hip to the corner 22. The second garment member 110 is brought over the right shoulder of the user and the corner 122 is then wrapped diagonally across the front to the left hip of the user. The corner 120 is then brought under the right arm and is wrapped across the user's back and is tied to the corner 122 at the left hip.

As best seen in FIG. 4B, the front non-stretchable edge 12 of the panel 10 and the similar edge 112 of panel 110 extend diagonally across the front of the user to insure that the breasts of the user will remain covered. The control knot 42 is disposed on the left shoulder of the user and lengthening or shortening it will change the position of the garment 40 on the user.

Figure 5A:
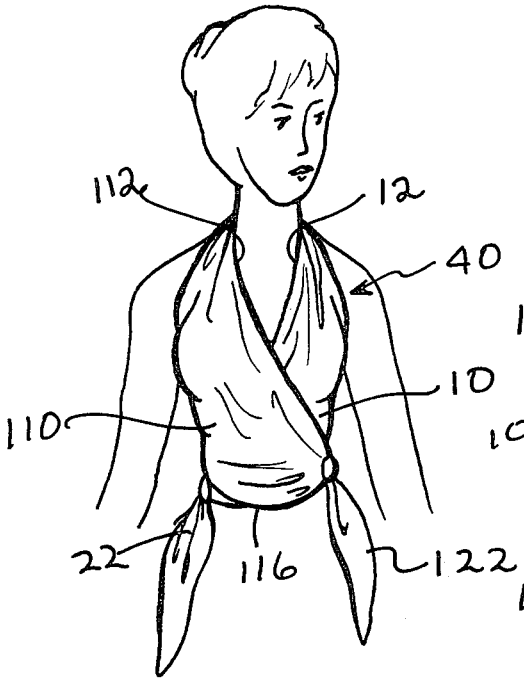
FIGS. 5A and 5B are front and rear views respectively illustrating another way of wearing the garment of the present invention.
Figure 5B:
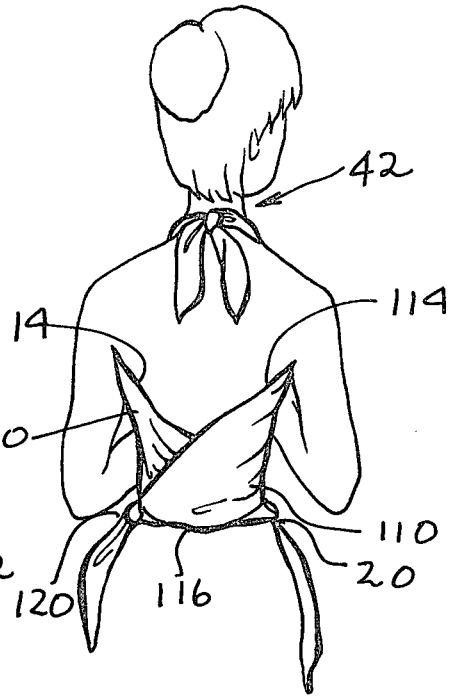

Referring to FIGS. 5A and 5B, it can be seen that this arrangement of the garment 40 is substantially identical to the arrangement shown in FIGS. 4A–4B except that the control knot 42 is positioned behind the neck of the user rather than over the left shoulder. FIG. 5B can be utilized to visualize how the back of the user would appear with the arrangement of the garment 40 in the manner shown in FIGS. 4A–4B.

Figure 6A:
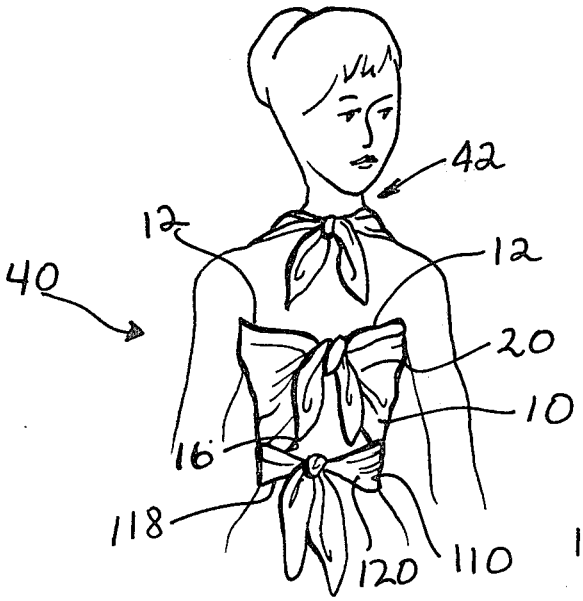
FIGS. 6A and 6B are front and rear views, respectively, illustrating an alternative style of wearing the garment of the present invention.
Figure 6B:
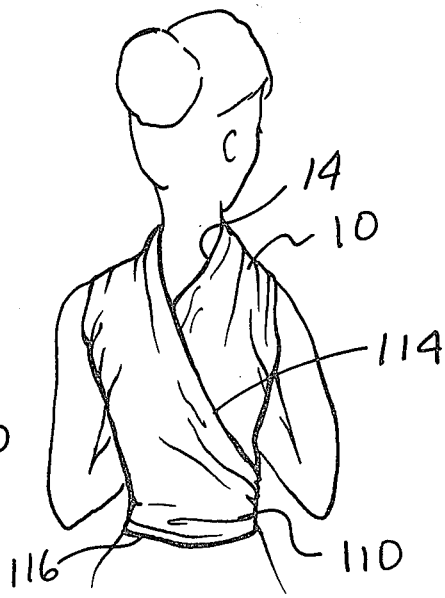

In the arrangement shown in FIGS. 6A–6B, the control knot 42 is formed by tying corner 18 of garment member 10 to the corner 118 of garment member 110. Corner 22 of the garment member 10 is wrapped around the back of the user and is brought under the right arm to be tied to the corner 20. The corner 20 is brought into position to be tied to corner 22 by wrapping the garment member 10 around the back and under the left arm of the user.

The corner 122 of the garment member 10 is wrapped under the right arm of the user and is tied to the corner 120 in the front of the user below the garment member 10. The corner 120 is brought into position by bringing it around the back of the user and under the left arm.

Again, the control knot 42 is positioned about the neck of the user so that the position of the garment 40 can be readily adjusted by adjusting the knot 42. Also the non-stretchable front edge 12 of the garment member 10 is disposed along the top of the breasts of the user to make the garment 40 conform better to the body of the user and to help insure that the breasts will stay beneath the garment 40.

Figure 7A:
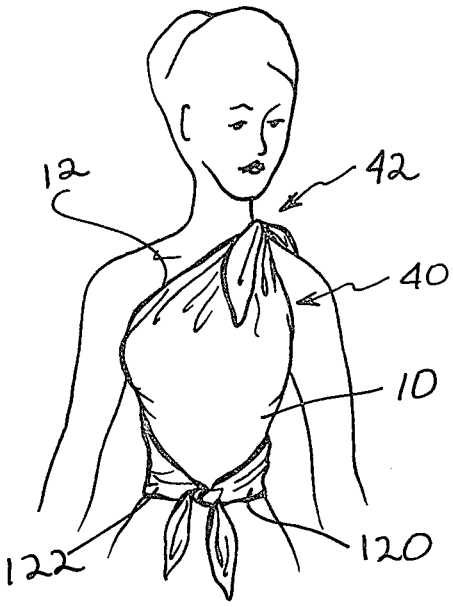
FIGS. 7A and 7B illustrate a still further style of wearing the garment of the present invention.
Figure 7B:
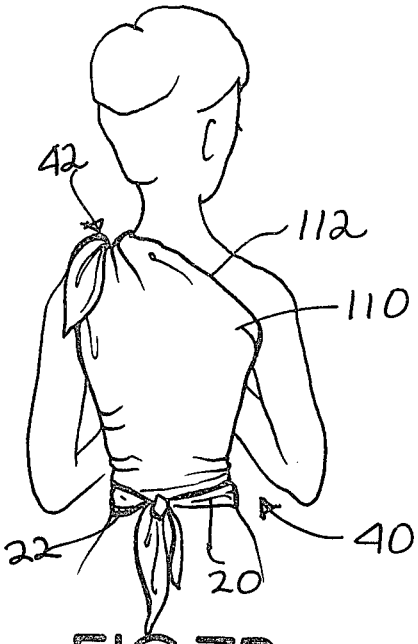

Referring now to the arrangement shown in FIGS. 7A–7B, corner 18 of garment member 10 is tied to corner 118 of garment 110 to form the control knot 42. The control knot 42 is positioned on the left shoulder of the user. The corner 22 of the garment member 10 is then brought under the right arm around the back of the user and is tied to corner 22 which has been brought under the left arm and around the back of the user.

The corner 122 of garment member 110 is brought around the back of the user and under the right arm. The corner 120 is brought under the left arm from the back of the user to the front and is tied in the front to the corner 122.

Again, the control knot 42 is positioned on the shoulder of the user and the front edge 12 extends across the upper front portion of the garment 40.

Figure 8A:
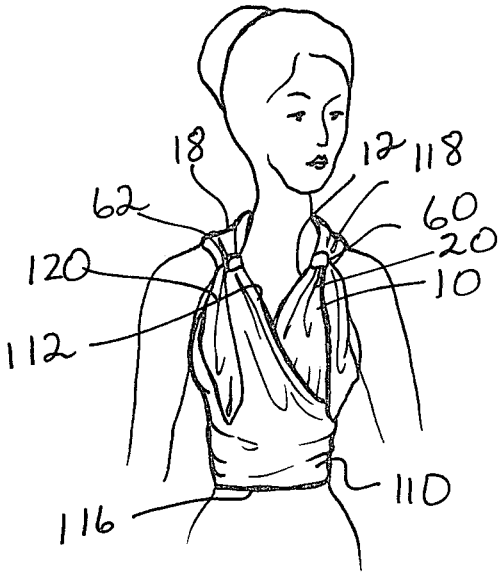
FIGS. 8A and 8B illustrate a still further style of wearing the garment of the present invention.
Figure 8B:
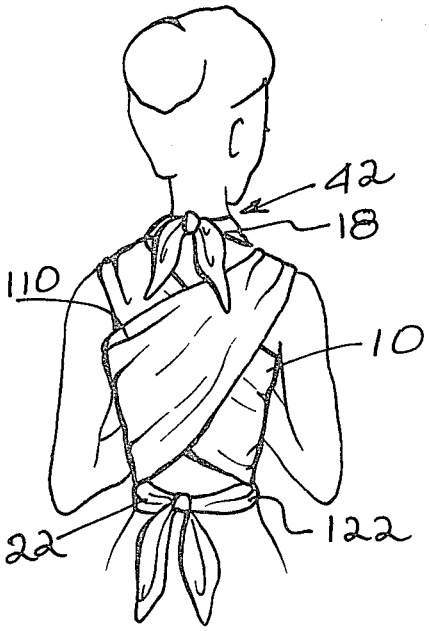

FIGS. 8A–8B show another preferred arrangement of the garment 40 in which the control knot 42 is formed at the back of the neck of the user by tying corner 18 of the garment member 10 to corner 118 of garment member 110. The corner 20 of garment member 10 is brought to the front of the wearer, under the user's right arm and across the back to the left shoulder. After the corner 20 has been brought over the left shoulder, it is tied to the portion of garment member 110 adjacent corner 118 to form a knot 60.

Corner 22 of garment member 10 is brought across the front and tied in back to corner 122 of garment member 110.

Corner 120 of garment member 110 is brought under the left arm of the user across the back and over the right shoulder of the user and is then tied to the portion of garment member 10 adjacent the corner 18 to form knot 62. The corner 122 is brought across the front of the user over the garment member 10 and is tied in the back to the corner 22 of garment member 10.

Again, it is apparent that the control knot 42 is disposed adjacent the shoulder of the user and provides the means for adjusting the size and the position of the garment. The non-stretchable front edge 12 of the garment member 10 and similar edge 112 of garment member 110 are disposed above and across the breasts to retain them in place.

FIGS. 9A and 9B illustrate yet another preferred arrangement of the garment 40 of the present invention in which the control knot 42 is positioned on the left shoulder of the user and is formed by tying corner 18 of garment member 10 to corner 118 of garment member 110. Corner 22 of garment member 10 is then wrapped across the front, under the right arm, across the lower back and is then tied to the corner 20 at the left hip of the user.

The garment member 110 is joined to the garment member 10 by the corner 118 and is wrapped around the head of the user with the corners 120 and 122 tied together as at 66 to hold the hood formed by garment member 110 in place.

Again, it is apparent that the control knot 42 is formed on the shoulder of the wearer and provides the means for raising and lowering the garment 40 so that it will accommodate wearers of different sizes and different body configurations.

The non-stretchable edge 12 of the garment member 10 extends above the breasts to conform to the body and to hold the garment 40 in place.

It should be apparent that only a few of a number of possible arrangements of the garment 40 have been described.

The garment members 10 and 110 can be of the same or different materials and if the garment members are constructed of two sheets of material, the different sheets can be different fabrics. This, too, provides versatility for the garment of the present invention.

The concave sides of the garment are important in that they enable the garment to more readily adapt to the body of the user.

Having described my invention, however, many modifications thereto will become apparent to those skilled in the art to which it pertains without departing from the spirit of the invention as defined by the scope of the appended claims.

I claim:

1. A garment comprising:

a first garment member, said first garment member being planar and substantially triangular in shape and having only three corners;

a second garment member, said second garment member being planar and substantially triangular in shape and having only three corners, said second garment member being separately constructed and detachable from said first garment member;

said garment being formed by wrapping said garment members around the body of a user and tying the corners of said member or members together wherein at least one corner of one member is tied to at least one corner of the other member to form a control knot; and said control knot regulating the position of said garment on the user.

2. The invention as defined in claim 1 wherein each garment member is constructed of a material which is stretchable in one direction and relatively non-stretchable in a direction substantially perpendicular to said first mentioned direction, one edge of each of said garment members being formed to extend in said non-stretchable direction; at least one of said last mentioned edges being disposed on the front of said user above the breasts thereof.

3. The invention as defined in claim 1 wherein two corners of at least one garment member are tied together.

4. The invention as defined in claim 1 wherein two corners of the first garment member are tied together and wherein two corners of the second garment member are tied together.

5. The invention as defined in claim 1 wherein each garment member further comprises a pair of substantially triangular sheets placed in registry with each other and means for securing said sheets together wherein said sheets are different colored.

6. The invention as defined in claim 5 wherein said means further comprises means for securing said sheets together along their edges.

7. The invention as defined in claim 1 wherein each garment member comprises a top corner and two lower corners, said lower corners having a lower edge extending therebetween, wherein the length of said lower edge is substantially twice the distance from the top corner and to the lower edge.

8. The invention as defined in claim 1 wherein each garment member further comprises a pair of side edges, each side edge extending from one lower corner and to the top corner, and wherein said side edges concave inwardly toward the center of the garment.

9. The invention as defined in claim 1 wherein said first and second garment members are substantially identical to each other.

* * * * *